United States Patent [19]

Stege

[11] Patent Number: 4,653,457

[45] Date of Patent: Mar. 31, 1987

[54] AIR CLEANER WITH CRANKCASE BREATHER ASSEMBLY

[75] Inventor: Jeffrey J. Stege, Flint, Mich.

[73] Assignee: General Motors Corporation, Detroit, Mich.

[21] Appl. No.: 842,554

[22] Filed: Mar. 21, 1986

[51] Int. Cl.[4] ..... F01M 13/00

[52] U.S. Cl. ..... 123/572; 55/DIG. 19

[58] Field of Search ..... 123/520, 572; 55/350, 55/DIG. 19, DIG. 28

[56] References Cited

U.S. PATENT DOCUMENTS

| | | | |
|---|---|---|---|
| 3,263,402 | 8/1966 | Lindamood | 123/572 |
| 3,589,108 | 6/1971 | Dingel | 123/572 |
| 3,759,015 | 9/1973 | Saxby | 55/DIG. 19 |
| 3,828,529 | 8/1974 | Frey | 55/DIG. 19 |
| 4,326,489 | 4/1982 | Heitert | 123/520 |
| 4,401,093 | 8/1983 | Gates | 123/572 |

*Primary Examiner*—Ronald B. Cox

*Attorney, Agent, or Firm*—Arthur N. Krein

[57] ABSTRACT

A crankcase breather for use in the air cleaner of the type used on an internal combustion engine is provided with a grooved, raised boss retainer portion on the outboard wall of the air filter container portion of the crankcase breather so as to encircle the nipple of the crankcase breather and the outer housing shell of the air cleaner is provided with a conforming aperture so that a part of the outer housing shell is received in the groove thus permitting the rest of the raised boss retainer portion to be snapped into locking engagement with the material edges defining the aperture.

1 Claim, 5 Drawing Figures

AIR CLEANER WITH CRANKCASE BREATHER ASSEMBLY

FIELD OF THE INVENTION

This invention relates to crankcase breathers for use with air cleaners for vehicle engines and, in particular, to a crankcase breather and method of assembly of the same to the outer housing shell of an air cleaner.

DESCRIPTION OF THE PRIOR ART

It is old in the art to provide an internal combustion engine with a crankcase ventilation system whereby crankcase vapors are carried from the engine crankcase to the inlet manifold or some other portion of the engine induction system. This type of system provides for the removal of blowby and other vapors which tend to collect in engine crankcases by drawing them into the induction system by the vacuum naturally formed by the operation of the system. Such a system also includes provision for the addition of fresh air to the crankcase which mixes with the crankcase vapors and is carried into the induction system therewith.

It is also old in the art to provide a filter means for filtering the air to be delivered to the crankcase as by incorporating such a filter means into the air filter element in the air cleaner for the engine in a manner as shown, for example, in U.S. Pat. No. 3,589,108 entitled "Air Cleaner for Crankcase Ventilation System" issued June 29, 1971 to Ronald J. Dingel and Wesly D. Tomlinson.

In another form, as presently used on various vehicle engines, the crankcase breather is formed as a separate or supplemental disposable filter assembly that is adapted to be mounted to the air cleaner housing and fixed thereto by a U-shaped, slotted spring clip retainer. This crankcase breather, made for example of a plastic material, is in the form of an open end, box-like, container having a breather nipple or tube connector conduit projecting outward from an apertured wall of the container. The container, filled with a suitable filter material, is formed with an arcuate shaped outer contour to conform substantially to the curved interior surface of the annular outer housing shell of the air cleaner housing whereby this container portion can be positioned inside of the air cleaner housing at a location radially outward of the conventional type, disposable air filter element mounted therein, and the outer housing shell is provided with an aperture through which the tube connector conduit can extend outboard of this housing shell. In addition, the tube connector conduit has an annular groove formed in its outer peripheral surface at a suitable axial distance from the container portion to receive the U-shaped, slotted spring clip retainer used to secure this crankcase breather to the outer housing shell of the air cleaner.

SUMMARY OF THE INVENTION

The present invention relates to an improved crankcase breather assembly and to the method of assembling the same to the outer housing shell of an air cleaner, the crankcase breather assembly having an open end container portion for filter material with an integral tube connector conduit extending outward from a longitudinal wall of the container portion, this longitudinal wall further having a raised stepped boss that defines a slot at its lower end and is of an external configuration formed complementary to a similar shaped opening provided in the outer housing shell, made of sheet metal, whereby the slot can slide over the material defining the lower portion of the opening in the outer housing shell and then it can be forced downward whereby with a force thereafter applied to the upper portion of the container will cause the remaining portion of the raised boss to snap into the opening so as to be engaged and retained by the material surrounding the opening whereby the opening is then sealed.

It is therefore a primary object of this invention to provide an improved disposable crankcase breather which is adapted for snap-fit assembly into the outer housing shell of an air cleaner and which is easy to remove and replace during normal servicing of the air cleaner.

For a better understanding of the invention as well as other objects and further features thereof, reference is had to the following detailed description of the invention to be read in connection with the accompanying drawings.

DESCRIPTION OF THE PREFERRED EMBODIMENT

Figure 1:
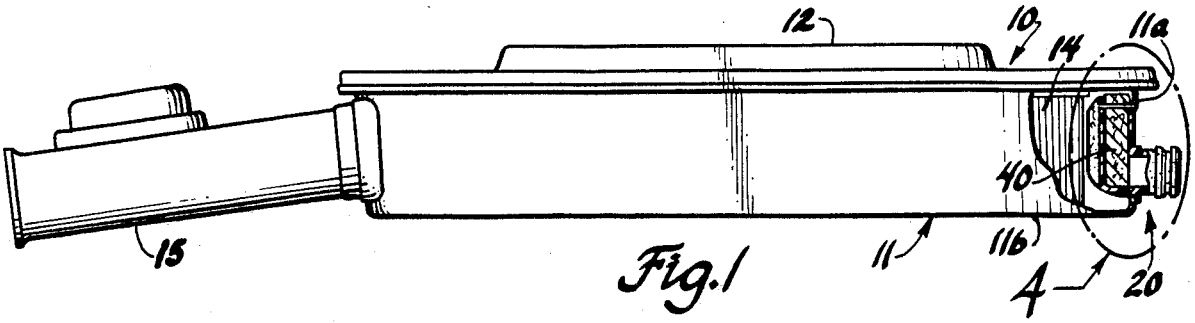
FIG. 1 is a side view of an air cleaner assembly as used on an internal combustion engine, with a portion thereof broken away in cross-section to show a crankcase breather in accordance with the invention incorporated therein.

Referring first to FIG. 1 there is shown an air cleaner 10 of the type used on internal combustion engines. Such an air cleaner 10 includes a housing formed by an outer housing shell 11 having a vertical or upright wall **11*a* of generally circular external configuration that interconnects with an apertured base portion 11*b* used to mount the air cleaner, for example, to a carburetor in a conventional manner and an upper cover member 12 that is normally releasably secured to the outer housing shell 11 in a conventional manner, not shown. The cover member 12 permits replacement of a conventional air filter 14 element supported within the housing that is used to filter air entering via a conventional air inlet tube or snorkel 15** suitably secured to the outer housing shell in a manner well known in the art prior to its induction into the engine.

Figure 4:
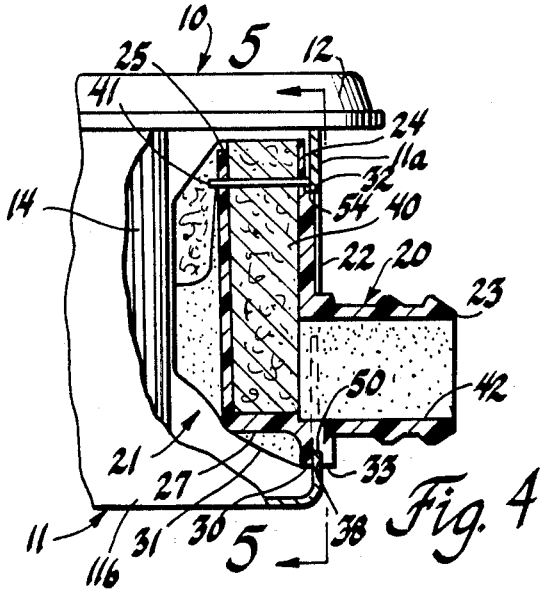
FIG. 4 is an enlarged view of the cut-away portion of FIG. 1 showing the crankcase breather of the invention mounted to the outer housing shell of the air cleaner; and, FIG. 5 is a sectional view taken along lines 5—5 of FIG. 4 showing the snap-in mounting of the crankcase breather into the outer housing shell.

In addition, a crankcase breather, generally designated 20, in accordance with the invention, is mounted into an aperture, provided for this purpose in the vertical wall of the outer housing shell wall **11*a* in a manner to be described, whereby the nipple or hose connecting conduit portion thereof extends outboard of the air cleaner housing as best seen in FIG. 1 and in greater detail in FIG. 4** so that it can be connected, as by a hose, not shown, to deliver clean air to the crankcase of an engine, not shown, in a manner well known in the art.

Figure 2:
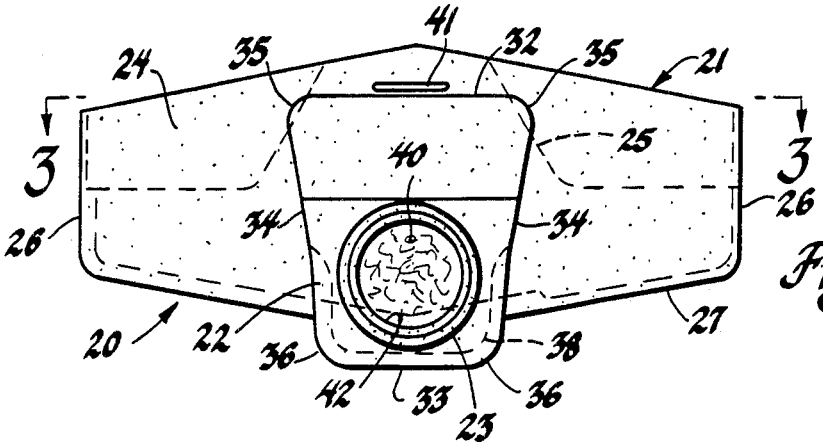
FIG. 2 is a front or discharge end view of the crankcase breather, per se, of FIG. 1.
Figure 3:
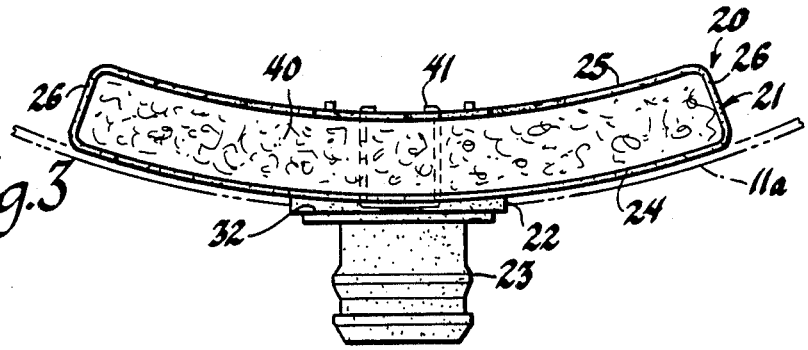
FIG. 3 is a top view of the crankcase breather taken along line 3—3 of FIG. 2 and showing a portion of the outer housing shell of the air cleaner.

Referring now to the crankcase breather 20, it includes, as best seen in FIGS. 2–5, an open-end box like filter container portion 21 adapted to support a raised and, in effect, slotted boss retainer portion 22 extending outward from the outboard wall of the container portion 21 and a tubular nipple or tube connector conduit 23, these elements being preferably molded of a suitable plastic material as an integral assembly. As shown, the filter container portion is of a suitable size so as to support an adequate quantity of a suitable filter material 40 therein, such as an oil impregnated foam filter pad of material, so that, preferably, the service intervals for replacement of the air filter 14 and crankcase breather 20 are substantially the same. Preferably, as best seen in FIGS. 3 and 4, the pad of filter material 40 is secured in the filter container portion by means of at least one staple 41.

As best seen in FIGS. 2, 3 and 4, the container portion 21 includes spaced apart arcuate shaped outboard and inboard walls 24 and 25, respectively, spaced apart side walls 26 and a bottom wall 27. As best seen in FIG. 2, each of the side walls 26, in the construction illustrated, only extend up to the associate reduced end height of the inboard wall 25. In addition, a lock tab wall 30, extends downward from the central portion of the bottom wall 27 with its outboard or free end face extending in a common plane with the outboard face of the outboard wall 24 and thus defines, in effect, both a downward extension of this wall and part of the boss retainer portion 22. Preferably, as shown, support ribs 31 are used to interconnect the opposite face of the lock tab wall 30 to the bottom wall 27, as best seen in FIG. 4, so as to reinforce this lock tab wall 30 against movement thereof out of the plane of the outboard face of the outboard wall 24.

As best seen in FIG. 3, the outboard wall 24 with the locking tab wall 30 is, in effect, of semi-circular configuration in the construction shown, with its outer surface having a radius corresponding to the radius of the inner peripheral surface of the wall **11*a* of the outer housing shell 11 whereby this outboard wall 24 and locking tab wall 30 can be positioned flush against the inner peripheral surface of the wall 11*a*** as shown in this Figure and in FIG. 4.

The raised and slotted boss retainer portion 22, as best seen in FIGS. 2 and 4, is of substantially trapezoidal external configuration with parallel upper and lower edges 32 and 33, respectively, with opposed outwardly upward extending side edges 34. Preferably as best seen in FIGS. 2 and 5, the upper edge 32 is connected at opposite ends to the side edges 34 by curved edges 35 of a predetermined radius, while the lower edge 33 is connected at opposite ends to the lower end of the side edges by curved edges 36 formed of a predetermined radius, as desired.

Figure 5:
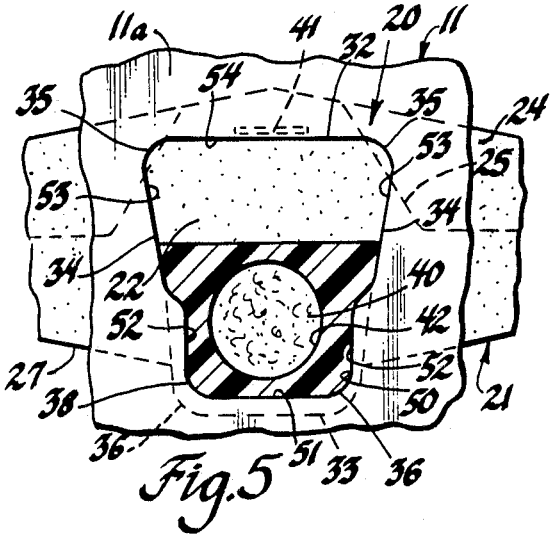

As best seen in FIGS. 4 and 5, the lower portion of the raised boss retainer portion 22 is of a configuration corresponding to that of the locking tab 30 and although formed integral with the outboard wall 24 and with a portion of the locking tab 30, has an outer peripheral portion thereof formed so as to be in spaced apart relationship to these elements whereby to define a U-shaped groove 38 of a width corresponding to the thickness of the wall **11*a*, so that a portion of this wall 11*a* surrounding an aperture 50 in the wall 11*a*, to be described hereinafter can be slidably received in the groove 38. As best seen in FIG. 3, the upper portion of the raised boss portion 22 is preferably at its outer side wall edges 34 of a thickness greater than the thickness of the wall 11*a* for a purpose to be described. With this arrangement, the outer or free surface of the raised boss portion 22 thus need not be of arcuate configuration so as to conform to the configuration of the wall 11*a* of the outer housing shell 11. As best seen in FIG. 4, a passage 42 extends through the tube connector conduit 23, the boss retainer portion 22 and outboard wall 24 for the passage of air through the filter material 40 and out through this passage 42**.

Referring now to the outer housing shell 11, the vertical wall **11*b* thereof is provided with an aperture 50 therethrough, which as best seen by the solid line outline thereof in FIG. 5 includes a lower edge 51 and lower side wall portions 52 that conform to the base of the groove 38 and upper side wall portions 53 and a top edge portion 54 which are of a configuration formed complementary to the remainder of the raised boss portion 22, including the curved edges 35 and 36** thereof.

To fasten the crankcase breather 20 into the air cleaner, the crankcase breather 20 is inserted from the inside of the outer housing shell 11 so that the tube connector conduit 23 can be extended out through the large upper portion of the aperture 50 in the wall **11*a*. The groove 38 in the crankcase breather 20 is then positioned over the lower edge 51 of the metal defining the aperture 50 and pushed downward capturing the adjacent sheet metal of the wall 11*a* in the slot. As the bottom base of the groove 38 comes to rest on the bottom edge 51, the position shown in FIGS. 1, 4 and 5, the top of the crankcase breather is then pushed in an outward direction so that the remainder of the raised boss retainer portion 22 snaps into the aperture 50, the plastic of the outboard wall 24 and of the raised boss retainer portion 22 being deflected slightly as force is applied thereto by the sheet metal of the wall 11*a* before the upper portion of raised boss retainer portion snaps into place. The force from this deflection is what permits the raised boss retainer portion 22 to snap into the aperture 50 and to thus become sealingly locked by the edges of the material of said upright wall 11*a* defining the aperture 50**.

It should now be apparent that when it is desired to replace the crankcase breather 20, it is then only necessary to apply sufficient force on the upper portion of the crankcase breather in a reverse or inboard direction to snap the upper portion of the raised boss retainer portion 22 out of engagement with the upper side edges and upper edge of the aperture 50, after which the slotted 38 portion of the crankcase breather 20 is lifted out of engagement from the wall **11*a*** to thus then permit complete removal of the crankcase breather from the air cleaner.

While the invention has been described with reference to the structure disclosed herein, it is not confined to the specific details set forth, since it is apparent that various modifications and changes can be made by those skilled in the art. This application is therefore intended to cover such modifications or changes as may come within the purposes of the improvements or scope of the following claim.

The embodiments of the invention in which an exclusive property or privilege is claimed are defined as follows:

1. A crankcase breather of the type having an air filter container portion with a tube connector conduit extending outward from an arcuate shaped outboard wall of the container portion and which is adapted to be secured in and against the upright wall of the outer housing shell of an air cleaner with the tube connector conduit project out through the upright wall of the outer housing shell, the improvement wherein said crankcase breather includes a raised boss retainer portion extending outward from said outboard wall and encircling said tube connector conduit, a U-shaped groove in the lower portion of said raised boss retainer portion and, wherein said upright wall of outer housing shell has an aperture therein of a configuration conforming to the base of said U-shaped groove and the adjacent upper portion of said raised boss retainer portion whereby said groove can receive a portion of the material of said upright wall defining said aperture and the remainder of said raised boss retainer portion can be snapped into locking engagement with the remaining edge portions of said upright wall defining said aperture.

* * * * *